United States Patent [19]

Godfrin et al.

[11] Patent Number: 4,691,633

[45] Date of Patent: Sep. 8, 1987

[54] IGNITER INTENDED FOR GAS-GENERATING CHARGES IN SHELLS

[75] Inventors: Jean-Philippe Godfrin, Plougastel-Daoulas; Bernard Landrevie, Saint-Medard en Jalles; Gérard Escache, L'Hay-les-Roses, all of France

[73] Assignee: Societe Nationale des Poudres et Explosifs, Paris, France

[21] Appl. No.: 871,557

[22] Filed: Jun. 6, 1986

[30] Foreign Application Priority Data

Jun. 6, 1985 [FR] France ..... 85 08548

[51] Int. Cl.[4] ..... F42B 13/267; F42C 19/08

[52] U.S. Cl. ..... 102/202; 102/380; 102/473; 102/501

[58] Field of Search ..... 102/202, 380, 490, 473, 102/374, 376, 501

[56] References Cited

U.S. PATENT DOCUMENTS

| | | | |
|---|---|---|---|
| 2,955,535 | 10/1960 | Show et al. | 102/531 |
| 2,995,088 | 8/1961 | Asplund | 102/202 |
| 3,613,758 | 10/1971 | Gawlick et al. | 149/15 |
| 3,698,321 | 10/1972 | Wall | 102/374 |
| 3,750,581 | 8/1973 | Betts et al. | 102/202 |
| 3,988,990 | 11/1976 | MacDonald, Jr. et al. | 102/380 |
| 4,130,061 | 12/1978 | Boggs et al. | 102/501 |
| 4,170,941 | 10/1979 | Reichard et al. | 102/202 |
| 4,197,800 | 4/1980 | Greever et al. | 102/517 |
| 4,213,393 | 7/1980 | Gunners et al. | 102/380 |
| 4,554,872 | 11/1985 | Schleicher | 102/490 |

FOREIGN PATENT DOCUMENTS

| | | |
|---|---|---|
| 2307248 | 11/1976 | France . |
| 2365777 | 4/1978 | France . |
| 2009373 | 6/1979 | United Kingdom . |
| 2131926 | 6/1984 | United Kingdom . |

*Primary Examiner*—Charles T. Jordan

*Attorney, Agent, or Firm*—Burns, Doane, Swecker & Mathis

[57] ABSTRACT

The pyrotechnic igniter comprises a strong outer casing (3) whose bottom is equipped with divergent peripheral openings (4) and an ignition charge (5) placed in this casing. In order to obtain reproducible thermodynamic characteristics during the firing of the gas-generating charge (1) with a central channel, while withstanding the very high accelerations produced when the gun is fired, the inner surface of the casing comprises a means of axial positioning of the charge which provides a free space (6) between the downstream face of the charge and the bottom of the casing, the ignition charge (5) comprising a peripheral sleeve (7) resting on the said means of axial positioning.

12 Claims, 2 Drawing Figures

IGNITER INTENDED FOR GAS-GENERATING CHARGES IN SHELLS

Figure 1:
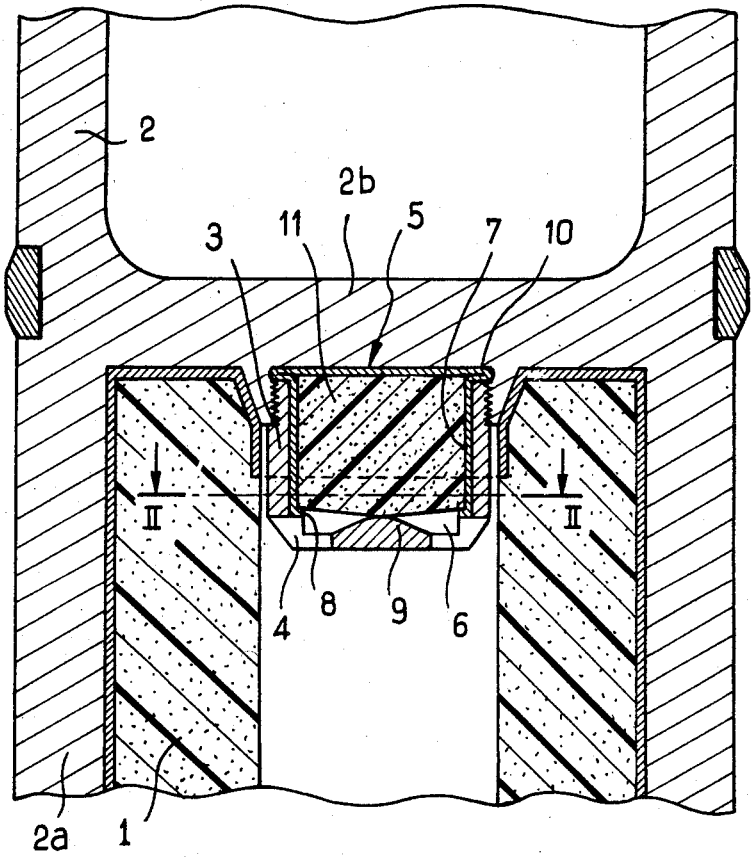

The invention relates to a pyrotechnic igniter which may be used in shells with additional propulsion and in shells with reduced bleed, this igniter comprising a strong outer casing whose bottom is equipped with divergent peripheral openings and an ignition charge placed in this casing.

Igniters of this type of construction have been known for many years in connection with the firing of propellent charges employed for additional propulsion of shells, and in most cases these charges are of a type referred to as "with a central channel" and are of great length. It is also known that, generally, the use of an igniter produces a slightly wider scatter of shell impacts during firing, and this is one of the main reasons why, after igniters placed upstream of the propellent charge have been used, as described, for example, in U.S. Pat. No. 3,698,321 of 1972, techniques have been developed for direct firing without the use of an igniter, one of these techniques being described in U.S. Pat. No. 4,197,800 of 1980.

At the present time, ignition of gas-generating charges with a central channel, which are placed at the base of the shell and which are intended to reduce the base-bleed of these shells, is produced by means of igniters which resemble those used for additional propulsion, but the results obtained are still not reproducible enough, and several techniques for direct firing of these charges, without employing an igniter placed upstream of the gas-generating charge, have been developed and are described, especially in U.S. Pat. No. 4,130,061 and in British Pat. No. 2,131,926. Such ignition techniques, either completely direct (GB No. 2,131,926) or employing a more sensitive priming composition (U.S. Pat. No. 4,130,061), considerably restrict the choice of the composition of the propellent charge or of the gas-generating charge and do not permit the most highly modified compositions to be used, especially those with reduced base-bleed, which requires compositions burning at a very low pressure while generating a high volume of combustion gas.

More particularly, where igniters which are placed upstream of the gas-generating charges and which enable the base-bleed of the shells to be reduced are concerned, Pats. No. FR 2,328,938 and No. FR 2,365,777 describe such igniters in accordance with different configurations. According to the former patent, the entire igniter is placed in the bottom of the shell and the openings for ejection of the ignition gases and of the incandescent particles are perforated in the bottom of the casing; this configuration is theoretically the best, since the gases carrying hot particles do not tend to erode the surface of the gas generating block, but it has been found that, under the particular conditions when a gun is fired, many blocks did not even ignite, whereas such a configuration would be perfectly suitable for a propellant or a gas generator which does not form part of a shell.

What appears to be the greatest difference lies in the fact that the ignition of a traditional self-propelled missile takes place while the nozzle of the missile is closed by a cover until a sufficient pressure is reached, whereas, in the operating mode of a charge placed in a shell, although a pressure of several thousand bars prevails initially in the channel of the gas-generating charge, immediately upon leaving the muzzle of the gun an abrupt emptying of the channel takes place, tending to extinguish the combustion surface of the propellant even if the latter was already partially ignited. According to the second French Patent No. FR 2,365,777, the igniter is placed in the region of the propellant block, permitting a saving in space, but the short length of the central channel entails a sideways or oblique ejection of the ignition gases in order that the ignition of the block may be achieved, whatever the propellant composition. On the other hand, such sideways ejection produces an erosive combustion of the gas-generating block of propellant, which is localized and poorly reproducible.

All the igniters intended for gas-generating charges in shells, whether this generation be limited in order to obtain a bleed reduction or whether it be considerable in order to obtain a propellent effect, are compact igniters whose casing is completely filled with the ignition charge. This charge contains either pyrotechnic components or a monolithic block produced by casting or by compression, which rest on the downstream bottom of the ignition casing, and this enables this charge to be supported during the acceleration stage of the shell in the barrel.

The purpose of the present invention is to obtain, on the one hand, completely reliable ignition of the gas-generating charge whatever the propellant composition employed, especially with the compositions characterized by a very low rate of combustion at a low pressure, which are difficult to ignite under the particular conditions under which the shells are fired, and, on the other hand, an improvement in the reproducibility of ignition, which directly affects the accuracy of long-range firing, one of the causes of scatter found with reduced-bleed shells when compared with normal shells being the nonuniformity of ignition conditions.

The invention is characterized in that the inner surface of the igniter casing comprises a means for axial positioning of the charge, which provides a free space between the downstream face of the charge and the bottom of the casing, the ignition charge consisting of a pyrotechnic block joined integrally to a peripheral sleeve resting on the said means of axial positioning.

According to a first embodiment the means of axial positioning consists of an internal shoulder of the casing on which the peripheral sleeve of the ignition charge is bearing, and according to a second embodiment this means of axial positioning consists of the inner surface of the igniter casing which is frustoconical, the bottom of this casing being joined to the small base of the conical frustum and the ignition charge itself being frustoconical with the same opening angle. These two preferred methods of implementation make it possible to provide a free space situated between the downstream face of the ignition charge and the bottom of the casing, the volume of this free space, and especially its height, being optimized as a function of the nature of the composition of the pyrotechnic ignition block, of the sizing of the divergent peripheral openings in the casing, and of the propellant composition in the gas-generating charge.

Advantageously, and particularly when the channel in the gas-generating charge is short, as is the case with the charges for reducing shell-bleed, the inner central zone of the bottom of the casing has a projection the thickness of which diminishes from the centre towards the periphery, such a deflector having an actual efficiency which varies with time as a function of the instantaneous distance existing between the burning surface of the pyrotechnic ignition composition and the bottom of the casing, and this enables the erosion of the propellant block of the gas-generating charge to be limited, while providing a very efficient sideways diffusion of the ignition gases, especially at the outset of the ignition. More particularly, this projection may consist of a conical member, a frustoconical shape or a complete cone making good deflection possible when the base circle of the conial member is substantially tangential to the inner part of the openings, the angle at the apex of the cone being preferably between 120° and 160°. When this projection is truncated, it is then advantageous that the height be substantially equal to the height of the free space provided by the means of axial positioning, so that this projection may at the same time form a deflector and a buttress supporting the ignition charge. The formation of a jet of ignition gas which is widely spread out transversely is particularly well marked in the initial phase of ignition when the bottom of the casing comprises openings which extend into the side thickness of this casing in the region of the free space, since this relative position with respect to the central deflector makes it possible to obtain a large sideways component of ejection, which is gradually attenuated and which avoids any localized and prolonged erosive combustion.

According to a particular embodiment, the peripheral sleeve of the ignition charge forms part of a cup whose bottom has a peripheral flange, and advantageously this flange consists of a rim whose two superposed thicknesses form a metal seal.

Advantageously, on the one hand, the pyrotechnic block of the ignition charge has a combustion time of more than 0.8 second, this time being more particularly between 1.5 and 2.5 seconds and, on the other hand, this block is made of a composition comprising from 16 to 25% of magnesium, an inorganic oxidizer, and from 2.5% to 6.5% of an organic binder such as a polymer.

The advantages obtained by virtue of this invention consist essentially in that at the beginning of the combustion of the pyrotechnic ignition block the heat flux, consisting of the combustion gases and the incandescent particles, is directed substantially sideways, which enables this heat flux to be concentrated on a restricted surface of the gas-generating charge, with the annular region of maximum effect of the heat flux gradually travelling towards the downstream end of the channel of the gas-generating charge whilst retaining a sufficient sideways diffusion to be effective over the surface of this channel. In addition, the creation of a free space, which has been found possible despite the thermodynamic and kinetic conditions of the firing of a gun, makes it possible to exploit a much greater initial surface area, the combination of these operating conditions making it possible to obtain a high reproducibility of the ignition conditions in the gas-generating charges, particularly in those used for bleed reduction, and this enables the accuracy of long-range firing to be considerably increased by reducing the scatter of impact points.

Figure 2:
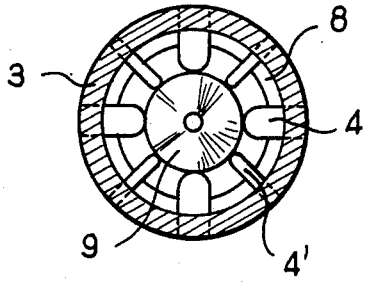

The invention is described below in greater detail with the aid of a drawing showing one of the two preferred embodiments of the invention, in which:

FIG. 1 is a partial view in axial lengthwise section of a shell, in the region of the igniter of a gas-generating charge, enabling the base-bleed of the shell to be reduced, and FIG. 2 is a cross-section along II—II of the outer casing of the igniter.

According to this drawing, which refers to a 155-millimeter calibre shell, the shell (2) is extended towards the rear by a peripheral skirt (2*a*) to which there is added a bottom (not shown) comprising a wide axial opening for the escape of combustion gases generated by the gas-generating charge (1) which consists of a propellant block with a central channel, externally inhibited, and placed in the combustion chamber within the skirt.

The igniter of the gas-generating charge has an external diameter which is slightly smaller than the diameter of the inner channel, ad the steel casing (3) of the igniter is screwed directly into the rear bossing of the bottom (2*b*) of the shell. The inner surface of this casing comprises a shoulder (8) whose width is slightly greater than the thickness of the peripheral sleeve (7) of the ignition charge, which consists of a light-alloy cup and of the monolithic pyrotechnic block (11). This pyrotechnic block is formed directly in this cup by compressing a powdered composition containing 16% of magnesium, 26% of barium peroxide, 50% of another alkali metal or alkaline-earth metal oxide or peroxide, and 8% of a polyester binder. Under the kinetic conditions of gun-firing, the ignition charge, with a total mass of 40 grams, must withstand a force of approximately 500 to 800 daN, and the use of a thin sleeve (7) requires the cup to be equipped with a peripheral fastening flange (10) which consists of a laterally pressed rim whose two superposed thicknesses form a metal seal, such a fastening flange being unnecessary in the case where the inner surface of the casing is frustoconical and receives an ignition charge which is itself frustoconical, when the whole of the side surface of the charge takes part in supporting this charge when the gun is fired. According to the example described, the pyrotechnic block has a free surface which is slightly frustoconical and which rests on the small base of the conical frustum (9) which is arranged inside the igniter casing, the large base of this projection being tangential to the ejection openings (4) and (4') which are radial slits cut into the bottom and into the tubular wall of the casing, this slit shape contributing to the gradual alteration in the direction of the maximum effect cone of the heat flux generated by the igniter, whose combustion time is 2.5 seconds. During static tests, all the specimens of gas-generating propellant of various compositions were fired under satisfactory conditions of reproducibility, and stable combustion of the majority of the specimens was obtained, at a pressure of 5 to 10 bars, after a period of the order of 0.6 to 0.8 second.

We claim:

1. Igniter intended for gas-generating charges (1) with a central channel, contained in shells (2), comprising, on the one hand, a strong outer casing (3) whose bottom is equipped with divergent peripheral openings (4) and, on the other hand, an ignition charge (5) placed in this casing, characterized in that the inner surface of the casing comprises a means for axial positioning of the charge which provides a free space (6) between the downstream face of the charge and the bottom of the casing, the ignition charge (5) consisting of a pyrotechnic block (11) integrally joined to a peripheral sleeve (7) resting on the said means of axial positioning.

2. Igniter according to claim 1, characterized in that the means of axial positioning consists of an inner shoulder (8) of the casing on which the peripheral sleeve (7) of the ignition charge is bearing.

3. Igniter according to claim 1, characterized in that the means of axial positioning consists of the inner surface of the casing (3), which is frustoconical, the bottom of the casing being joined to the small base of the conical frustum.

4. Igniter according to claim 1, characterized in that the inner central region of the bottom of the casing comprises an internal projection (9) whose thickness diminishes from the centre towards the periphery.

5. Igniter according to claim 4, characterized in that the projection (9) is a conical member whose base circle is substantially tangential to the inner part of the openings.

6. Igniter according to claim 5, characterized in that the angle at the apex of the cone is between 120° and 160°.

7. Igniter according to claim 4, characterized in that the height of the central projection (9) is substantially equal to the height of the free space (6) provided by the means of axial positioning.

8. Igniter according to claim 2, characterized in that the bottom of the casing comprises openings which extend into the side thickness of this casing in the region of the free space (6).

9. Igniter according to claim 2, characterized in that the peripheral sleeve (7) forms part of a cup whose bottom has a peripheral flange (10).

10. Igniter according to claim 9, characterized in that the flange consists of a rim whose two thicknesses form a metal seal.

11. Igniter according to claim 1, characterized in that the pyrotechnic block (11) has a combustion time of more than 0.8 second.

12. Igniter according to claim 11, characterized in that the pyrotechnic block (11) is made of a composition comprising from 16 to 25% of magnesium, an inorganic oxidizer and from 2.5 to 6% of organic binder.

* * * * *